US012305641B2

(12) United States Patent
Tan et al.

(10) Patent No.: US 12,305,641 B2
(45) Date of Patent: May 20, 2025

(54) ROTOR ASSEMBLY, COMPRESSOR AND AIR CONDITIONER

(71) Applicant: Gree Electric Appliances, Inc. of Zhuhai, Guangdong (CN)

(72) Inventors: Jianming Tan, Guangdong (CN); Hua Liu, Guangdong (CN); Zhiping Zhang, Guangdong (CN); Han Tang, Guangdong (CN); Xiaokun Wu, Guangdong (CN); Zhongkeng Long, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 18/269,428

(22) PCT Filed: Oct. 25, 2021

(86) PCT No.: PCT/CN2021/126066
§ 371 (c)(1),
(2) Date: Jun. 23, 2023

(87) PCT Pub. No.: WO2022/179143
PCT Pub. Date: Sep. 1, 2022

(65) Prior Publication Data

US 2024/0084802 A1 Mar. 14, 2024

(30) Foreign Application Priority Data

Feb. 26, 2021 (CN) ..... 202110216925.X

(51) Int. Cl.
*F04C 18/16* (2006.01)
*F04C 29/00* (2006.01)
*F04C 29/12* (2006.01)

(52) U.S. Cl.
CPC ..... *F04C 18/16* (2013.01); *F04C 18/165* (2013.01); *F04C 29/0021* (2013.01);
(Continued)

(58) Field of Classification Search
CPC .... F04C 18/16; F04C 18/165; F04C 29/0021; F04C 29/12; F04C 2240/20; F04C 2240/52
See application file for complete search history.

(56) References Cited

U.S. PATENT DOCUMENTS 5,393,209 A * 2/1995 Mohr ..... F01C 1/16 418/202
5,895,210 A 4/1999 Nakaniwa et al.
(Continued)

FOREIGN PATENT DOCUMENTS

CN 103109090 A 5/2013
CN 103939345 A 7/2014
(Continued)

OTHER PUBLICATIONS

CN 111997900A—Zhang et al.—Sliding Valve Assembly for Reducing Energy Efficiency Attenuation of Compressor and Compressor—Nov. 27, 2020—the English Machine Translation. (Year: 2020).*
(Continued)

*Primary Examiner* — Theresa Trieu
(74) *Attorney, Agent, or Firm* — The Webb Law Firm

(57) ABSTRACT

A compressor, including: a first rotor being rotatable around a first axis, the first rotor including a first portion and a second portion; and a first shaft carrying the first portion and the second portion, the first shaft having a first end and a second end that are oppositely arranged. The first rotor is configured to be applied with a preset acting force in a direction from the first end toward the second end or from the second end toward the first end during rotation. The size
(Continued)

of the compressor can be reduced with the displacement of the compressor remaining substantially unchanged.

26 Claims, 6 Drawing Sheets

(52) U.S. Cl.
CPC ..... *F04C 29/12* (2013.01); *F04C 2240/20* (2013.01); *F04C 2240/52* (2013.01)

(56) References Cited

U.S. PATENT DOCUMENTS

| | | | | |
|---|---|---|---|---|
| 9,228,590 | B2 | 1/2016 | Nachtergaele et al. | |
| 11,725,658 | B2 | 8/2023 | Li | |
| 2008/0085207 | A1 | 4/2008 | Mosemann et al. | |
| 2008/0260562 | A1 | 10/2008 | Van Der Heggen et al. | |
| 2013/0101390 | A1* | 4/2013 | Nachtergaele | F04C 18/16 |
| 2019/0128261 | A1 | 5/2019 | Akei | |
| 2019/0170143 | A1* | 6/2019 | Chiba | F04C 18/16 |

FOREIGN PATENT DOCUMENTS

| | | | |
|---|---|---|---|
| CN | 107787411 | A | 3/2018 |
| CN | 111043033 | A | 4/2020 |
| CN | 111997900 | A | 11/2020 |
| CN | 112796998 | A | 5/2021 |
| CN | 215256787 | U | 12/2021 |
| EP | 0791750 | A1 | 8/1997 |
| EP | 3480468 | A2 | 5/2019 |
| GB | 2082680 | A | 3/1982 |
| SE | 8701977 | | 11/1988 |
| WO | 2012000066 | A2 | 1/2012 |
| WO | 2018024201 | A1 | 2/2018 |

OTHER PUBLICATIONS

CN111043033—Wu et al.—Screw Rod compressor and Air Conditioner—Apr. 21, 2020—the English Machine Translation. ( Year: 2020).*

* cited by examiner

ROTOR ASSEMBLY, COMPRESSOR AND AIR CONDITIONER

CROSS-REFERENCE TO RELATED APPLICATIONS

This application is the United States national phase of International Application No. PCT/CN2021/126066 filed Oct. 25, 2021 and claims priority to Chinese Patent Application No. 202110216925.X, filed Feb. 26, 2021, the disclosures of which are hereby incorporated by reference in their entireties.

BACKGROUND OF THE INVENTION

Field of the Invention

This disclosure relates to the technical field of compressors, and in particular to a rotor assembly, a compressor and an air conditioner.

Description of Related Art

The compressor is generally provided with a pair of parallel helical rotors placed within the spatial volume of a housing of the screw compressor. During the rotation of the pair of helical rotors, the spatial volume will increase and decrease periodically, so that the spatial volume is periodically connected with and closed from an air inlet and an exhaust port to complete the air suction, compression and exhaust.

During the rotation of the pair of helical rotors, axial forces in two opposite directions will be formed along the rotation axis of the helical rotors. In order to limit the axial forces in two directions during the rotation of the helical rotors, two thrust bearings are arranged on a rotating shaft carrying the helical rotors to limit the axial forces in two directions, so that the helical rotors rotate in a relatively stable way.

However, the compressor with a pair of parallel helical rotors has a displacement associated with its size, and the size of the compressor is determined by the displacement. Compressors which are relatively small in size often have insufficient displacement, so they cannot be used in some occasions that require a compressor with a small size and a large displacement.

SUMMARY OF THE INVENTION

Embodiments of this disclosure provide a rotor assembly, a compressor, and an air conditioner, which can reduce the size of the compressor with the displacement of the compressor remaining substantially unchanged.

An embodiment of this disclosure provides a compressor, including:

a first rotor being rotatable around a first axis, the first rotor including a first portion and a second portion; and a first shaft carrying the first portion and the second portion, the first shaft having a first end and a second end that are oppositely arranged; wherein the first rotor is configured to be applied with a preset acting force in a direction from the first end toward the second end or from the second end toward the first end during rotation.

In an optional embodiment of this disclosure, the compressor further includes:

a second rotor being rotatable around a second axis, the second rotor including a third portion engaged with the first portion and a fourth portion engaged with the second portion; and a second shaft carrying the third portion and the fourth portion, wherein the first rotor and the second rotor are configured to be applied with a preset acting force in a direction from the first end toward the second end or from the second end toward the first end during rotation.

In an optional embodiment of this disclosure, the first portion is of a different shape from the second portion and the fourth portion; and/or the third portion is of a different shape from the second portion and the fourth portion so that an air pressure difference is generated during the rotation of the first rotor and the second rotor to form the preset acting force.

In an optional embodiment of this disclosure, the shapes of the first portion, the second portion, the third portion and the fourth portion include any one of length, the number of helical blades, end surface profile, the density of the helical blades, and diameter.

In an optional embodiment of this disclosure, the first portion and/or the third portion is provided with first air supply holes, the second portion and/or the fourth portion is provided with second air supply holes, the first air supply holes and the second air supply holes are configured to be different from each other to generate an air pressure difference during the rotation of the first rotor and the second rotor to form the preset acting force.

In an optional embodiment of this disclosure, the number of first air supply holes is different from the number of second air supply holes; and/or the size of the first air supply hole is different from the size of the second air supply hole; and/or a distance between the first air supply holes and an end surface of the first portion away from the second portion is different from a distance between the second air supply holes and an end surface of the second portion away from the first portion; or/and a distance between the first air supply holes and an end surface of the third portion away from the fourth portion is different from a distance between the second air supply holes and an end surface of the fourth portion away from the third portion.

In an optional embodiment of this disclosure, at least one of the first portion and the third portion is provided with air supply holes; and/or at least one of the second portion and the fourth portion is provided with air supply holes.

In an optional embodiment of this disclosure, a portion of the housing corresponding to the first portion has a different shape from portions of the housing corresponding to the second portion and the fourth portion; and/or a portion of the housing corresponding to the third portion has a different shape from the portions of the housing corresponding to the second portion and the fourth portion so that an air pressure difference is generated during the rotation of the first rotor and the second rotor to form the preset acting force.

In an optional embodiment of this disclosure, the housing is provided with a first exhaust port and a second exhaust port, and the length of the first exhaust port along a direction from the first end toward the second end is different from the length of the second exhaust port along a direction from the second end toward the first end.

In an optional embodiment of this disclosure, the portion of the housing corresponding to the first portion and/or the portion of the housing corresponding to the third portion is provided with first air supply holes, and the portion of the housing corresponding to the second portion and/or the portion of the housing corresponding to the fourth portion is provided with second air supply holes;

the number of first air supply holes is different from the number of second air supply holes; and/or the size of the first air supply hole is different from the size of the second air supply hole; and/or a distance between the first air supply holes and an end surface of the first portion away from the second portion is different from a distance between the second air supply holes and an end surface of the second portion away from the first portion; or/and a distance between the first air supply holes and an end surface of the third portion away from the fourth portion is different from a distance between the second air supply holes and an end surface of the fourth portion away from the third portion.

In an optional embodiment of this disclosure, at least one of the portion of the housing corresponding to the first portion and the portion of the housing corresponding to the third portion is provided with air supply holes, and/or at least one of the portion of the housing corresponding to the second portion and the portion of the housing corresponding to the fourth portion is provided with air supply holes.

In an optional embodiment of this disclosure, the first portion and the second portion are arranged along the direction of gravity, the third portion and the fourth portion are arranged along the direction of gravity, and the gravity of the first portion, the second portion, the third portion, the fourth portion, the first shaft and the second shaft causes the first rotor and the second rotor to be applied with the preset acting force during the rotation of the first rotor and the second rotor; or the arrangement direction of the first portion and the second portion has an included angle less than 90 degrees relative to the direction of gravity, the arrangement direction of the third portion and the fourth portion is the same as that of the first portion and the second portion, component forces of the first portion, the second portion, the third portion, the fourth portion, the first shaft and the second shaft along the direction of gravity cause the first rotor and the second rotor to be applied with the preset acting force during the rotation of the first rotor and the second rotor.

In an optional embodiment of this disclosure, the compressor further includes a magnetic member, and the magnetic member is configured to generate a magnetic force so that the first rotor and the second rotor are applied with the preset acting force during rotation.

In an optional embodiment of this disclosure, the compressor further includes an oil passage system, and a pressure of the oil passage system acting on the first end is lower than a pressure of the oil passage system acting on the second end so that the first rotor and the second rotor are applied with the preset acting force during rotation; or a pressure of the oil passage system acting on the third end is lower than a pressure of the oil passage system acting on the fourth end so that the first rotor and the second rotor are applied with the preset acting force during rotation.

In an optional embodiment of this disclosure, the compressor further includes:

a first thrust bearing arranged at the first end or the second end, the preset acting force being to be applied to the first thrust bearing.

In an optional embodiment of this disclosure, the first shaft is not provided with a thrust bearing, and both the first portion and the second portion are made of non-metallic materials.

In an optional implementation manner of this disclosure, the first shaft is not provided with a thrust bearing, a first anti-collision structure is arranged between an end of the first portion away from the second portion and the housing of the compressor, and a second anti-collision structure is arranged between an end of the second portion away from the first portion and the housing of the compressor.

In an optional embodiment of this disclosure, the compressor further includes:

a first thrust bearing arranged at the first end or the second end; and a second thrust bearing arranged at the third end or the fourth end, the preset acting force being to be applied to the first thrust bearing and the second thrust bearing.

In an optional embodiment of this disclosure, the compressor further includes:

a first thrust bearing arranged at the first end or the second end, the preset acting force being to be applied to the first thrust bearing;

wherein the second shaft is not provided with a thrust bearing and both the third portion and the fourth portion are made of non-metallic materials;

wherein the first portion and/or the second portion is integrally formed with the first shaft, and the third portion and the fourth portion can rotate around the second shaft.

In an optional embodiment of this disclosure, the compressor further includes:

a first thrust bearing arranged at the first end or the second end, the preset acting force being to be applied to the first thrust bearing;

wherein the first shaft is not provided with a thrust bearing, a third anti-collision structure is arranged between an end of the third portion away from the fourth portion and the housing of the compressor, and a fourth anti-collision structure is arranged between an end of the fourth portion away from the third portion and the housing of the compressor;

wherein the first portion and/or the second portion are/is integrally formed with the first shaft, and the third portion and the fourth portion can rotate around the second shaft.

An embodiment of this disclosure provides a compressor, including:

a housing provided with a first exhaust port and a second exhaust port;

a first rotor being rotatable within the housing around a first axis, the first rotor including a first portion and a second portion; and a second rotor being rotatable within the housing around a second axis, the second rotor including a third portion engaged with the first portion and a fourth portion engaged with the second portion;

wherein the first exhaust port is located at the same ends of the first rotor and the second rotor, the second exhaust port is located at the same ends of the first rotor and the second rotor, the first exhaust port and the second exhaust port are located at different ends of the first rotor, the first exhaust port and the second exhaust port are located at different ends of the second rotor, the length of the first exhaust port in a direction parallel with the first axis is greater than the length of the second exhaust port in a direction parallel with the first axis.

In an optional embodiment of this disclosure, the compressor further includes:

a first shaft carrying the first portion and the second portion;

a second shaft carrying the third portion and the fourth portion; and a first thrust bearing arranged on the first shaft and located on the same sides of the first portion or the second portion.

An embodiment of this disclosure provides a compressor, including:

a housing;

a first rotor being rotatable within the housing around a first axis, the first rotor including a first portion and a second portion; and a second rotor being rotatable within the housing around a second axis, the second rotor including a third portion engaged with the first portion and a fourth portion engaged with the second portion;

at least one of the first portion, the third portion, a portion of the housing corresponding to the first portion and a portion of the housing corresponding to the third portion is provided with first air supply holes, and at least one of the second portion, the fourth portion, the portion of the housing corresponding to the second portion and the portion of the housing corresponding to the fourth portion is provided with second air supply holes.

the number of first air supply holes is less than the number of second air supply holes; and/or the size of the first air supply hole is less than the size of the second air supply hole; and/or a distance between the first air supply holes and an end surface of the first portion away from the second portion is greater than a distance between the second air supply holes and an end surface of the second portion away from the first portion; or/and In an optional embodiment of this disclosure, the compressor further includes:

a first shaft carrying the first portion and the second portion;

a second shaft carrying the third portion and the fourth portion; and a first thrust bearing arranged on the first shaft and located on the same sides of the first portion or the second portion.

An embodiment of this disclosure provides a compressor, including:

a housing;

a first rotor being rotatable within the housing around a first axis, the first rotor including a first portion and a second portion; and a second rotor being rotatable within the housing around a second axis, the second rotor including a third portion engaged with the first portion and a fourth portion engaged with the second portion;

wherein the first portion, the third portion, a portion of the housing corresponding to the first portion and a portion of the housing corresponding to the third portion are all not provided with any air supply holes, and at least one of the second portion, the fourth portion, the portion of the housing corresponding to the first portion and the portion of the housing corresponding to the fourth portion is provided with air supply holes.

In an optional embodiment of this disclosure, the compressor further includes:

a first shaft carrying the first portion and the second portion;

a second shaft carrying the third portion and the fourth portion; and a first thrust bearing arranged on the first shaft and located on the same sides of the first portion or the second portion.

An embodiment of this disclosure further provides a rotor assembly, including:

a first rotor, including a first portion and a second portion that being rotatable around a first axis; and a second rotor being rotatable around a second axis, the second rotor including a third portion engaged with the first portion and a fourth portion engaged with the second portion;

wherein the first portion and/or the third portion is provided with first air supply holes, and the second portion and/or the fourth portion is provided with second air supply holes;

the number of first air supply holes is less than the number of second air supply holes; and/or the size of the first air supply hole is less than the size of the second air supply hole; and/or a distance between the first air supply holes and an end surface of the first portion away from the second portion is greater than a distance between the second air supply holes and an end surface of the second portion away from the first portion; or/and An embodiment of this disclosure further provides a rotor assembly, including:

a first rotor, including a first portion and a second portion that being rotatable around a first axis; and a second rotor being rotatable within the housing around a second axis, the second rotor including a third portion engaged with the first portion and a fourth portion engaged with the second portion;

wherein at least one of the first portion and the third portion is provided with air supply holes; and/or at least one of the second portion and the fourth portion is provided with air supply holes.

An embodiment of this disclosure further provides a rotor assembly, including: a first rotor being rotatable around a first axis, wherein the first rotor includes a first portion provided with first air supply holes and a second portion provided with second air supply holes;

the number of first air supply holes is less than the number of second air supply holes; and/or the size of the first air supply hole is less than the size of the second air supply hole; and/or a distance between the first air supply holes and an end surface of the first portion away from the second portion is greater than a distance between the second air supply holes and an end surface of the second portion away from the first portion; or/and An embodiment of this disclosure further provides a rotor assembly, including: a first rotor being rotatable around a first axis, wherein the first rotor includes a first portion and a second portion, and at least one of the first portion and the second portion is provided with air supply holes.

An embodiment of this disclosure further provides an air conditioner, including the compressor according to any one of the above embodiments; or including the rotor assembly according to any one of the above embodiments.

In the embodiment of this disclosure, the first portion and the second portion of the first rotor carried by the first shaft can rotate around the first axis and can be applied with a preset acting force in a single direction during the rotation of the first rotor. For example, the first rotor is applied with a preset acting force in a direction from the first end toward the second end during the rotation of the first rotor. For another example, the first rotor is applied with a preset acting force in a direction from the second end toward the first end during the rotation of the first rotor. The embodiment of this disclosure can realize that the compressor is applied with an axial force in a single direction during operation, and then the specific direction of the axial force in the single direction can be determined during the operation of the compressor, so that relevant measures can be taken to limit the axial force in the single direction without limiting the direction in which the axial force is not applied. Compared with the prior art, in the case where the axial force is not determined or the axial force is applied to two ends, the embodiments of this disclosure only need to limit the axial force toward one end instead of limiting two ends of the first shaft. Therefore, the embodiments of the present disclosure can reduce the size of the compressor without substantially affecting the displacement of the compressor and without substantially affecting the stability of the compressor.

In an embodiment of this disclosure, the first rotor can be engaged with other rotor structures, such as the second rotor, during rotation, the first portion of the first rotor is engaged with the third portion of the second rotor, and the second portion of the first rotor is engaged with the fourth portion of the second rotor, thus forming two sets of rotor pairs. Compared with the prior art, the embodiment of this disclosure provides the engagement of the first rotor and the second rotor, which is equivalent to the parallel connection of two screw compressors. Therefore, compared with the screw compressor in the prior art, the compressor in the embodiment of the disclosure can greatly reduce the size of the compressor in the case of the same or similar displacement. Combined with the embodiment of this disclosure, the compressor can realize the axial acting force in a single direction during the rotation of the first rotor and the second rotor through the preset acting force. Compared with the prior art that uses two thrust bearings to limit one rotor structure, the embodiment of this disclosure can use one thrust bearing to limit one rotor to operate stably, so as to further reduce the size of the compressor in the case where the displacement of the compressor in the embodiment of this disclosure is basically the same as that of the existing screw compressor.

BRIEF DESCRIPTION OF THE DRAWINGS

To more clearly illustrate the technical solutions in the embodiments of this disclosure, the drawings that need to be used in the description of the embodiments will be described briefly. Obviously, the drawings used in the following description are merely some embodiments of this disclosure. For those skilled in the art, other drawings may also be obtained according to these drawings without any creative efforts.

For a more complete understanding of this disclosure and its beneficial effects, the following description will be made in conjunction with the accompanying drawings, where the same reference numerals in the following description represent the same parts.

10. first shaft; 11. first axis; 12. first end; 14. second end;

20. first rotor; 22. first portion; 221. first air supply hole; 222. first helical blade; 223. first exhaust end surface; 24. second portion; 241. second air supply hole; 242. second helical blade; 243, second exhaust end surface;

30. second shaft; 31. second axis; 32. third end; 34. fourth end;

40. second rotor; 42. third portion; 421. third air supply hole; 422. third helical blade; 423. third exhaust end surface; 44. fourth portion; 442. fourth helical blade; 443. fourth exhaust end surface;

50. first thrust bearing;

60. housing; 62. fourth air supply hole; 64. fifth air supply hole;

70. second thrust bearing;

80. transmission assembly; 82. first transmission member; 84. second transmission member;

90. driving motor; 92. motor rotor; motor stator;

200. compressor, 201. first exhaust port; 202. second exhaust port; 203. suction port;

H1. first direction;

H2. second direction;

L1, the distance between the first air supply hole and the first exhaust end surface;

L2, the distance between the second air supply hole and the second exhaust end surface;

L3, the length of the first exhaust port along the first direction;

IA, the length of the second exhaust port along the second direction;

L5, the length of the first portion along the direction of the first axis;

L6, the length of the second portion along the direction of the first axis;

L7, first distance; and

L8, second distance.

DESCRIPTION OF THE INVENTION

The technical solutions in embodiments of this disclosure will be described clearly and completely hereinafter with reference to the accompanying drawings in the embodiments of this disclosure. Apparently, embodiments described here are merely part, not all of embodiments of this disclosure. The following description of at least one example is merely illustrative in fact, and is by no means any limitation on this disclosure and its application or use. All other embodiments obtained by those skilled in the art based on the embodiments of this disclosure without creative efforts shall fall within the scope of this disclosure.

Reference herein to "embodiment" or "implementation" means that a particular feature, structure or characteristic described in connection with the embodiment or implementation may be included in at least one embodiment of this disclosure. The appearances of the phrase in various places in the description do not necessarily refer to the same embodiment, or to independent or alternative embodiments mutually exclusive of other embodiments. Those skilled in the art clearly and implicitly understand that the embodiments described herein can be combined with other embodiments.

Embodiments of this disclosure provide a rotor assembly, a compressor and an air conditioner.

Figure 1:
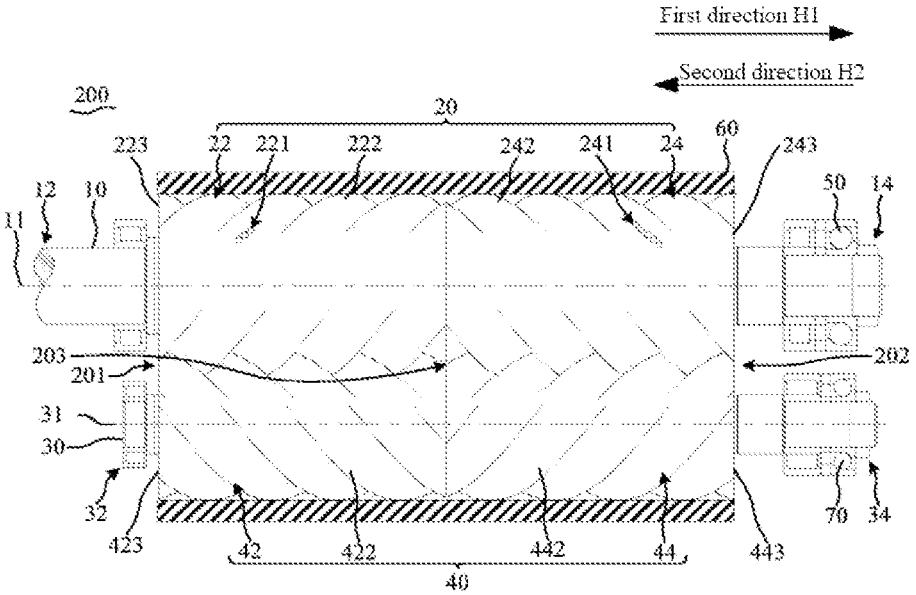
FIG. 1 is a schematic diagram of a part of a compressor according to a first embodiment of this disclosure.

Referring to FIG. 1, it shows a schematic diagram of a part of a compressor according to a first embodiment of this disclosure. As shown in FIG. 1, the compressor 200 may be a screw compressor. For example, the compressor 200 is an opposed screw compressor. It should be noted that the compressor 200 shown in FIG. 1 is not limited to a screw compressor. For example, the compressor 200 may also be a scroll compressor. The compressor 200 includes a first shaft 10, a first rotor 20, a second shaft 30, a second rotor 40, a first thrust bearing 50 and a housing 60. The housing 60 may accommodate the first rotor 20 and the second rotor 40, and the housing 60 may accommodate a portion of the first shaft 10 and a portion of the second shaft 30.

The housing 60 has an accommodating space for accommodating the first rotor 20, the second rotor 40, a portion of the first shaft 10, and a portion of the second shaft 30. The housing 60 further has a first exhaust port 201, a second exhaust port 201, and a suction port 203 communicating with the accommodating space for accommodating the first rotor 20, the second rotor 40, a portion of the first shaft 10, and a portion of the second shaft 30. The suction port 203 is configured to transmit the air outside the housing 60 to the accommodating space in the housing 60 when the first rotor 20 and the second rotor 40 are engaged with each other and rotate together. and the first exhaust port 201 and the second exhaust port 202 are configured to compress the air in the accommodating space of the housing 60 to the outside of the housing 60 when the first rotor 20 and the second rotor 40 are engaged with each other and rotate together. In this way, the processes of air suction, compression and exhaust of the compressor 200 can be realized. The first exhaust port 201 and the second exhaust port 202 are located at two ends of the housing 60 along the direction of the first axis 11 of the first shaft 10. The suction port 203 is located in the middle of the housing 60 along the direction of the first axis 11 of the first shaft 10.

It should be noted that the terms "first", "second", etc. in the description and the claims of this disclosure are used to distinguish different objects, rather than describing a specific order. In addition, the terms "including" and "having" and any variations thereof are intended to cover non-exclusive inclusion.

The first rotor 20 and the second rotor 40 are engaged with each other. In the embodiment of this disclosure, the first rotor 20 may be a male rotor, and the second rotor 40 may be a female rotor. In other embodiments of this disclosure, the first rotor 20 may be a female rotor, and the second rotor 40 may be a male rotor. The embodiments of the present disclosure will be described below in detail by taking the first rotor 20 as a male rotor and the second rotor 40 as a female rotor as an example.

The first rotor 20 as a male rotor can be understood as that the first rotor 20 is a driving rotor, and the second rotor 40 as a female rotor can be understood as that the second rotor 40 is a driven rotor. For example, the first rotor 20 may be drivingly connected to a driving assembly such as an electric motor (including but not limited to a permanent magnet motor). The first rotor 20 can be driven to rotate by the driving assembly, and when the first rotor rotates 20, the second rotor 40 is driven to rotate together.

The first rotor 20 is carried by the first shaft 10 and is drivingly connected to the driving assembly through the first shaft 10. The driving assembly can drive the first shaft 10 to rotate, and the first shaft 10 can rotate around the first axis 11 of the first shaft 10 together with the first rotor 20 carried by the first shaft. That is, the first rotor 20 can rotate within the housing 60 around the first axis 11. In the embodiment of this disclosure, the first rotor 20 may be integrally formed with the first shaft 10. In other embodiments of this disclosure, a portion of the first rotor 20 can be integrally formed with the first shaft 10, and a portion of the first rotor 20 can be fitted over the first shaft 10. In other embodiments of this disclosure, the first rotor 20 may be directly fitted over the first shaft 10.

In an example, the first rotor 20 may have at least two portions. For example, the first rotor 20 has a first portion 22 and a second portion 24, and both the first portion 22 and the second portion 24 may be integrally formed with the first shaft 10. One of the first portion 22 and the second portion 24, for example, the first portion 22, can be integrally formed with the first shaft 10, and the other portion, for example, the second portion 24, is fitted over the first shaft 10. Both the first portion 22 and the second portion 24 are fitted over the first shaft 10.

Figure 2:
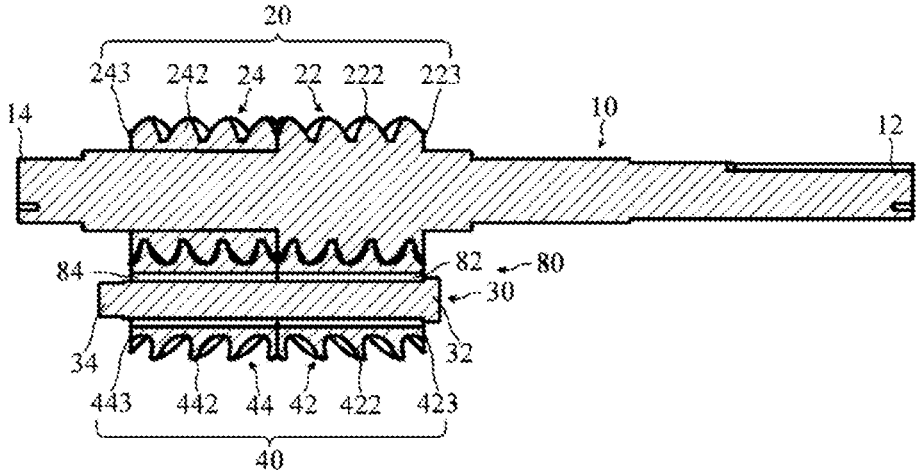
FIG. 2 is a schematic diagram of cooperation of a first rotor, a second rotor, a first shaft and a second shaft in the compressor according to an embodiment of this disclosure.

Referring to FIG. 2, it is a schematic diagram of cooperation of a first rotor, a second rotor, a first shaft and a second shaft in the compressor according to an embodiment of this disclosure. The first portion 22 of the first rotor 20 can be integrally formed with the first shaft 10, and the second portion 24 is fitted over the first shaft 10 and adjacent to the first portion 22. In the embodiment of this disclosure, the adjacent end surfaces of the first portion 22 and the second portion 24 can be attached to each other. In other embodiments of this disclosure, the adjacent end surfaces of the first portion 22 and the second portion 24 may also not be attached to each other and have a small gap therebetween, such as 0.1 mm, 0.2 mm, 0.3 mm, or the like.

Referring to FIGS. 1 and 2 again, the first rotor 20 has helical blades, also called male blades. The first rotor 20 includes a first helical blade 222 located in the first portion 22 and a second helical blade 242 located in the second portion 24. There may be a plurality of first helical blades 222 and there may be a plurality of the second helical blades 242. In the embodiment of this disclosure, the first helical blade 222 and the second helical blade 242 are configured to have opposite helical directions, that is, the rotation directions of the first portion 22 and the second portion 24 are opposite. When the first rotor 20 and the second rotor 40 are engaged with each other and rotate together, opposite axial forces are generated between the first helical blades 222 and the second helical blades 242, which can also be understood as that opposite axial flows are generated between the first helical blades 222 and the second helical blades 242. Due to the symmetry of the axial force, the opposite axial forces generated between the first helical blades 222 and the second helical blades 242 can almost be counterbalanced.

It should be noted that, in the description of this disclosure, "plurality" means two or more, unless otherwise specifically defined.

Referring to FIGS. 1 and 2 again, the second rotor 40 is carried by the second shaft 30, the second shaft 30 is configured to rotatably support the second rotor 40, and the second rotor 40 can rotate relative to the second shaft 30. The second rotor 40 is engaged with the first rotor 20 and can be driven by the first rotor 20 to rotate on the second shaft 30 around the second axis 31 of the second shaft 30. The second rotor 40 may have at least two portions. For example, the second rotor 40 has a third portion 42 and a fourth portion 44, and the third portion 42 and the fourth portion 44 are both fitted over the second shaft 30. Both the third portion 42 and the fourth portion 44 are rotatable within the housing 60 around the second axis 31.

The third portion 42 is engaged with the first portion 22 and the fourth portion 44 is engaged with the second portion 24. The rotation direction of the third portion 42 is opposite to rotation direction of the first portion 22, and the rotation direction of the fourth portion 44 is opposite to the rotation direction of the second portion 24.

The second rotor 40 has helical blades, also called female blades. The second rotor 40 includes a third helical blade 422 located in the third portion 42 and a fourth helical blade 442 located in the fourth portion 44. There may be a plurality of third helical blades 422 and there may be a plurality of the fourth helical blades 442. In the embodiment of this disclosure, the third helical blade 422 and the fourth helical blade 442 are configured to have opposite helical directions, that is, the rotation directions of the third portion 42 and the fourth portion 44 are opposite. When the first rotor 20 and the fourth rotor 40 are engaged with each other and rotate together, opposite axial forces are generated between the first helical blades 422 and the fourth helical blades 442, which can also be understood as that opposite axial flows are generated between the third helical blades 422 and the fourth helical blades 442. Due to the symmetry of the axial force, the opposite axial forces generated between the third helical blades 422 and the fourth helical blades 442 can almost be counterbalanced.

The second shaft 30 can carry the third portion 42 and the fourth portion 44 through one or more transmission assemblies 80. For example, the third portion 42 is fitted over a first transmission member 82 in the transmission assembly 80, and the fourth portion 44 is fitted over the second transmission member 84 in the transmission assembly 80. The first transmission member 82 and the second transmission member 84 may be sliding bearings or rolling bearings.

Referring to FIG. 1 again, the first shaft 10 has a first end 12 and a second end 14, and the first portion 22 and the second portion 24 of the first rotor 20 are arranged between the first end 12 and the second end 14. The second shaft 30 has a third end 32 and a fourth end 34 between which the third portion 42 and the fourth portion 44 of the second rotor 40 are confined. The first portion 22 has a first exhaust end surface 223 located at the first exhaust port 201 and a first suction end surface (not shown) located at the suction port 203, and the second portion 24 has a second exhaust end surface 243 located at the second exhaust port 202 and a second suction end surface located at the suction port 203 (not shown). The first suction end surface is adjacent to the second suction end surface, and in the embodiment of this disclosure, the first suction end surface and the second suction end surface may or may not be attached to each other. In an embodiment of this disclosure, the first shaft 10 may be parallel to the second shaft 30, and the first axis 11 of the first shaft 10 may be parallel to the second axis 31 of the second shaft 30.

The third portion 42 has a third exhaust end surface 423 located at the first exhaust port 201 and a third suction end surface (not shown) located at the suction port 203, and the fourth portion 44 has a fourth exhaust end surface 443 located at the second exhaust port 202 and a fourth suction end surface located at the suction port 203 (not shown). The first suction end surface is adjacent to the second suction end surface, and in the embodiment of this disclosure, the first suction end surface and the second suction end surface are spaced apart from each other to ensure that the first portion 22 and the fourth portion 44, and the second portion 24 and the third portion 42 do not interfere.

The housing 60 has a fifth exhaust end surface (not shown) located at the first exhaust port 201 and a sixth exhaust end surface (not shown) located at the second exhaust port. The fifth exhaust end surface may be spaced apart from the first exhaust end surface 223 and the third exhaust end surface 423 at a distance less than a first preset value, so that the fifth exhaust end surface, the first exhaust end surface 223, and the third exhaust end surface 423 are always spaced apart from each other and will not collide with each other easily. The sixth exhaust end surface may be spaced apart from the second exhaust end surface 243 and the fourth exhaust end surface 443 at a distance less than the first preset value, so that the fifth exhaust end surface, the first exhaust end surface 223, and the third exhaust end surface 423 are always spaced apart from each other and will not collide with each other easily.

The first thrust bearing 50 is arranged on the first shaft 10, for example, on the second end 14 of the first shaft 10. In some other embodiments of this disclosure, the first thrust bearing 60 is arranged on the first end 12.

Regarding the first rotor 20 and the second rotor 40, when the first rotor 20 and the second rotor 40 are engaged with each other and rotate together, since the opposite rotation directions of the first portion 22 and the second portion 24 can generate opposite axial forces, and the opposite rotation directions of the third portion 42 and the fourth portion 44 can generate opposite axial forces, the axial forces between the first portion 22 and the second portion 24 can be counterbalanced to some extent, and the axial forces between the third portion 42 and the fourth portion 44 can be counterbalanced to some extent.

However, it should be noted that in the actual production and processing process, it is found that, on the one hand, there are some differences in the structure of different parts of the first rotor 20 due to manufacturing deviations, and there are some differences in the structure of different parts of the second rotor 40. Moreover, there will also be differences between the first rotor 20 and the second rotor 40. On the other hand, due to the problems of tolerances and deviations in assembly, there are certain differences in assembly of the first rotor 20 and the second rotor 40. As a result, the axial forces between the first portion 22 and the second portion 24 cannot be completely counterbalanced, and the axial forces between the third portion 42 and the fourth portion 44 cannot be completely counterbalanced. When the first rotor 20 and the second rotor 40 are engaged with each other and rotate together, the axial forces cannot be almost completely counterbalanced to form a resultant force of axial forces in random directions. The resultant axial force may be toward the first direction H1, and the resultant axial force may also be toward the second direction H2.

On the other hand, in the quantification of compressor products, due to the differences between the rotors in each compressor, the directions of the resultant axial forces generated by the rotors in each compressor are different. For example, in some compressors, the direction of the resultant axial force of the rotors is toward the first direction H1, and in some compressors, the direction of the resultant axial force of the rotors is toward the second direction H2. That is, a resultant force with random axial direction and random value appears in the entire rotor shaft system, so that the entire shaft system is randomly pushed to one of the two exhaust end surfaces, causing the exhaust end surface of the rotor on this side to contact and nub against the end surface of the housing and resulting in occurrence of a failure.

In the related art, in order to ensure the stable operation of all formed compressors, two sets of thrust bearings (also called axial force bearings) are fitted over each shaft of the compressor to realize position limitation on the resultant force of axial forces of rotors in all the formed compressors, thus ensuring the stable operation of all the formed compressors.

Therefore, it is still unavoidable to use the thrust bearing for bearing and position limitation, and due to the randomness of the resultant force direction, the thrust bearing needs to meet the requirement for bearing and position limitation in two directions. That is, in the actual production and processing process of the compressor, in order to ensure the limitation on the resultant force of the axial forces of the rotors, the thrust bearings (axial force bearings) are still required for limitation in two directions on one rotating shaft. For example, the compressor is equipped with two sets of thrust bearings with opposite bearing directions to ensure that the resultant force of axial forces in two random directions is borne. However, for an independent individual compressor, the direction of the resultant axial force that appears randomly is always the same. In this case, one set of thrust bearing is used for position limitation, and the other set of thrust bearing is completely idle, thereby causing low cost performance, extra mechanical loss and lubricating oil demand, and increasing the failure rate of the compressor. This will eventually lead to an increase in the size and cost of the compressor assembly, reduce the mechanical efficiency of the shafting operation to a certain extent, and increase the lubricating oil demand.

Based on this, the embodiment of this disclosure ensures that when the first rotor 20 and the second rotor 40 of the compressor 200 are engaged with each other and rotate together, the first rotor 20 and the second rotor 40 are applied with a resultant axial force in a determined and single axial direction. Therefore, in the embodiment of this disclosure, it is only required to arrange the first thrust bearing 50 on one shaft such as the first shaft 10 to realize the limitation on the resultant axial force in the determined and single axial direction, thereby ensuring that the first rotor 20 and the second rotor 40 of the compressor 200 in the embodiment of this disclosure can rotate stably without causing contact and friction between the exhaust end surfaces of the rotors and the end surface of the housing. Compared with the related art where two thrust bearings are required to be fixed on one shaft, the compressor of the embodiment of this disclosure can avoid the use of multiple thrust bearings and reduce the overall size and cost of the compressor. Moreover, due to the reduction in the number of thrust bearings, the efficiency of shafting operation can be improved to a certain extent, and the demand for lubricating oil can be reduced.

In some embodiments of this disclosure, by designing the internal structure of the compressor 200 to have a preset difference in the production and processing process of the compressor 200, it can be ensured that the compressor 20 produces a resultant force of axial forces in a determined and unique direction between the first rotor 20 and the second rotor 40. For example, the compressor 200 in the embodiment of this disclosure can form a pressure difference in a preset direction through the differences in hole and slot structures.

The following describes the shape in the compressor 200 used to accommodate the first rotor 20 and the second rotor 40, and the shape difference between the first rotor 20 and the second rotor 40 that causes the formation of a pressure difference.

In the embodiment of this disclosure, during the rotation of the first rotor 20 and the second rotor 40, only a preset acting force in a determined and single direction is applied to the first thrust bearing 50. The direction of the preset acting force may be a preset acting force from the second end 14 toward the first end 12. The direction from the second end 14 toward the first end 12 may be defined as second direction H2, and the direction from the first end 12 toward the second end 14 can be defined as first direction H1. The preset acting force can be understood as a resultant axial force formed when the first rotor 20 and the second rotor 40 are engaged with each other and rotate together. During the rotation of the first rotor 20 and the second rotor 40, the axial force of the first rotor 20 and the second rotor 40 along the first direction H1 is less than the axial force of the first rotor 20 and the second rotor 40 along the second direction H2 to form a preset acting force applied to the first thrust bearing 50.

In the embodiment of this disclosure, the shapes of the first portion 22 and the third portion 42 are different from the shapes of the second portion 24 and the fourth portion 44, so as to generate a pressure difference during the rotation of the first rotor 20 and the second rotor 40 to form a preset acting force applied to the first thrust bearing 50. It can be understood that the shape of the first portion 22 is different from the shapes of the second portion 24 and the fourth portion 44; and/or, the shape of the third portion 42 is different from the shapes of the second portion 24 and the fourth portion 44, so as to generate a pressure difference during the rotation of the first rotor 20 and the second rotor 40 to form a preset acting force.

The cases where the shapes of the first portion 22 and the third portion 42 are different from the shapes of the second portion 24 and the fourth portion 44 include but are not limited to the following: the shape of the first portion 22 is different from the shape of the second portion 24, and the shape of the third portion 42 is different from the shape of the fourth portion 44; the shape of the first portion 22 is different from the shape of the second portion 24, and the shape of the third portion 42 is the same as the shape of the fourth portion 44; the shape of the first portion 22 is the same as the shape of the second portion 24, and the shape of the third portion 42 is different from the shape of the fourth portion 44; the shape of the first portion 22 is different from the shape of the fourth portion 44, and the shape of the third portion 42 is different from the shape of the fourth portion 44; the shape of the first portion 22 is different from the shape of the fourth portion 44, and the shape of the third portion 42 is the same as the shape of the fourth portion 44; the shape of the first portion 22 is the same as the shape of the fourth portion 44, and the shape of the third portion 42 is different from the shape of the fourth portion 44; the shape of the first portion 22 is different from the shape of the fourth portion 44, and the shape of the third portion 42 is the same as that of the second portion 24; the shape of the first portion 22 is different from the shape of the fourth portion 44, and the shape of the third portion 42 is different from the shape of the second portion 24; the shape of the first portion 22 is the same as the shape of the fourth portion 44, and the shape of the third portion 42 is different from the shape of the second portion 24; the shape of the first portion 22 is different from the shape of the fourth portion 44, and the shape of the third portion 42 is the same as the shape of the fourth portion 44.

Figure 3:
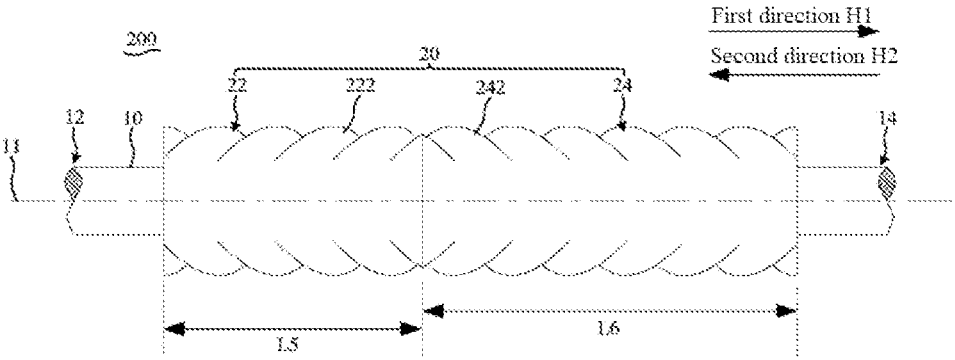
FIG. 3 is a schematic diagram of a part of a compressor according to a second embodiment of this disclosure.

Referring to FIG. 3, it shows a schematic diagram of a part of a compressor according to a second embodiment of this disclosure. In some embodiments, the cases where the shapes of the first portion 22 and the third portion 42 are different from the shapes of the second portion 24 and the fourth portion 44 include but are not limited to the following: the shapes of the first portion 22, the second portion 24, the third portion 42 and the fourth portion 44 include any one of length, the number of helical blades, end surface profile, the density of the helical blades, and diameter. It can be understood that the cases where the shapes of the first portion 22 and the third portion 42 are different from the shapes of the second portion 24 and the fourth portion 44 include but are not limited to the following: the shapes of the first portion 22, the second portion 24, the third portion 42 and the fourth portion 44 include at least two of length, the number of helical blades, end surface profile, the density of the helical blades, and diameter.

The length L5 of the first portion 22 of the first rotor 20 in the compressor 200 shown in FIG. 3 along the direction of the first axis is different from the length L6 of the second portion 24 along the direction of the first axis. For example, the length L5 of the first portion 22 along the direction of the first axis 11 is less than the length L6 of the second portion 24 along the direction of the first axis 11. In some optional embodiments, the number of helical blades 242 of the second portion 24 is greater than the number of helical blades 222 of the first portion 22.

During the operation of the compressor 200, both the first portion 22 and the second portion 24 rotate around the first axis 11. Since the length of the second portion 24 along the direction of the first axis 11 is greater than the length L5 of the first portion 22 along the direction of the first axis 11, the first rotor 20 forms a resultant axial force in the second direction H2 during rotation, thereby realizing the axial force orientation.

It should be noted that the way to realize the axial force orientation by the different shapes of the first portion 22 and the second portion 24 is not limited to, for example, that the diameters of the first portion 22 and the second portion 24 and the densities of the helical blades 222 of the first portion 22 and the helical blades 242 of the second portion 24 are different and that the thicknesses of the helical blades 222 of the first portion 22 and the helical blades 242 of the second portion 24 and the end surface profiles of the first portion 22 and the second portion 24 are different.

In the embodiment of this disclosure, at least one of the first portion 22 and the third portion 42 is provided with first air supply holes 221, and at least one of the second portion 24 and the fourth portion 44 is provided with second air supply holes 241. The first air supply holes 221 and the second air supply holes 241 are configured to be different from each other so as to generate an air pressure difference during the rotation of the first rotor 20 and the second rotor 40 to form a preset acting force applied to the first thrust bearing 50. The number of first air supply holes 221 may be one or mor, and the number of second air supply holes 241 may be one or more.

In an optional embodiment of this disclosure, referring to FIG. 1, the number of first air supply holes 221 is less than the number of second air supply holes 241. For example, the number of first air supply holes 221 is three, and the number of second air supply holes 241 is five. During the air supply process, the air supply volumes of the second portion 24 and the fourth portion 44 are greater than the air supply volumes of the first portion 22 and the third portion 42. During the rotation of the first rotor 20 and the second rotor 40, the air pressure formed by the first portion 22 and the third portion 42 is less than the air pressure formed by the second portion 24 and the fourth portion 44. Therefore, the air pressure difference between the first rotor 20 and the second rotor 40 is applied to the first thrust bearing 50 along the second direction H2. The embodiment of this disclosure realizes axial force orientation, and it is easiest to change the number of formed air supply holes, so this disclosure is suitable for models with the economizer air supply turned on in all working conditions.

Figure 4:
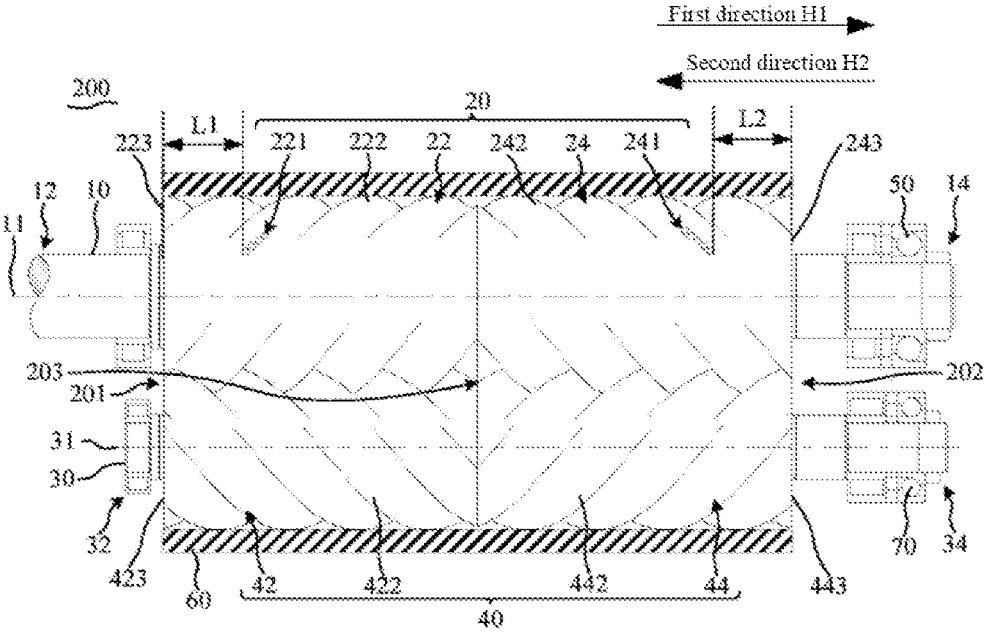
FIG. 4 is a schematic diagram of a part of a compressor according to a third embodiment of this disclosure.

In an optional embodiment of this disclosure, referring to FIG. 4, it shows a schematic diagram of a part of a compressor according to a third embodiment of this disclosure. A distance between the first air supply holes 221 and an end surface of the first portion 22 away from the second portion 24 is greater than a distance between the second air supply holes 241 and an end surface of the second portion 24 away from the first portion 22. That is, the distance L1 between the first air supply holes 221 and the first exhaust end surface 223 is greater than the distance L2 between the second air supply holes 241 and the second exhaust end surface 243. In some other embodiments, a distance between the first air supply holes 221 and an end surface of the third portion 42 away from the fourth portion 44 is greater than a distance between the second air supply holes 241 and an end surface of the fourth portion 44 away from the third portion 42. That is, the distance between the first air supply holes 221 and the third exhaust end surface 423 is greater than the distance between the second air supply holes 241 and the second exhaust end surface 243. During the air supply process, the second portion 24 and the fourth portion 44 can be supplied with air earlier than the first portion 22 and the third portion 42. During the rotation of the first rotor 20 and the second rotor 40, the air pressure formed by the first portion 22 and the third portion 42 is less than the air pressure formed by the second portion 24 and the fourth portion 44. Therefore, the air pressure difference between the first rotor 20 and the second rotor 40 is applied to the first thrust bearing 50 along the second direction H2. In the embodiment of this disclosure, it is easy to change the axial position of each air supply hole, so this disclosure is suitable for models with the economizer air supply turned on in all working conditions.

Figure 5:
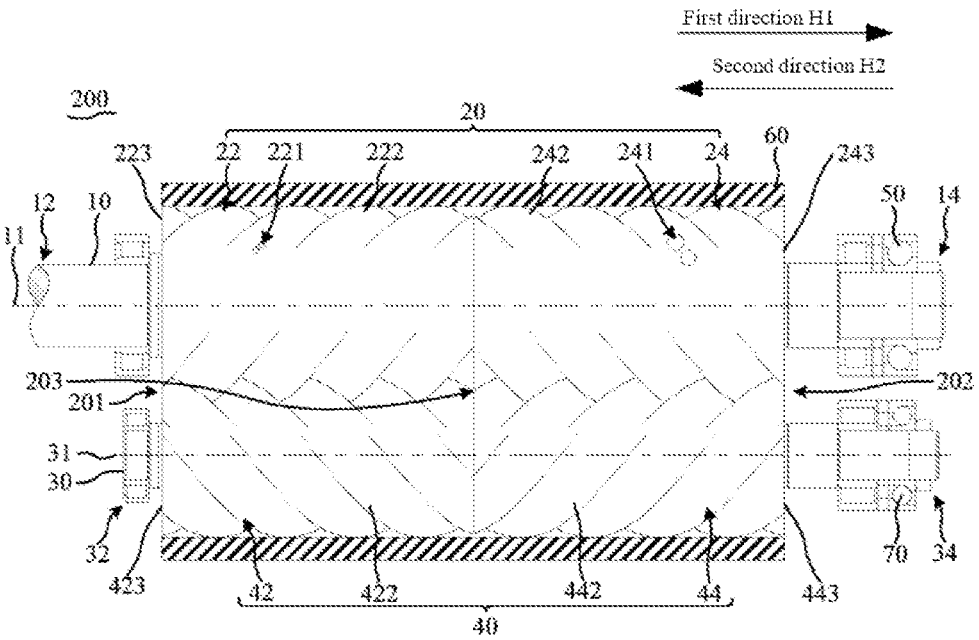
FIG. 5 is a schematic diagram of a part of a compressor according to a fourth embodiment of this disclosure.

In an optional embodiment of this disclosure, referring to FIG. 5, it shows a schematic diagram of a part of a compressor according to a fourth embodiment of this disclosure. The size of the first air supply hole 221 is less than the size of the second air supply hole 241. During the air supply process, the air supply volumes of the second portion 24 and the fourth portion 44 are greater than the air supply volumes of the first portion 22 and the third portion 42. During the rotation of the first rotor 20 and the second rotor 40, the air pressure formed by the first portion 22 and the third portion 42 is less than the air pressure formed by the second portion 24 and the fourth portion 44. Therefore, the air pressure difference between the first rotor 20 and the second rotor 40 is applied to the first thrust bearing 50 along the second direction H2.

In an optional embodiment of this disclosure, referring to FIGS. 1, 4 and 5, the first air supply holes 221 are formed in the first portion 22 and the second air supply holes 241 are formed in the second portion 24.

In an optional embodiment of this disclosure, the first air supply holes 221 are formed in the first portion 22 and the second air supply holes 241 are formed in the fourth portion 44.

Figure 6:
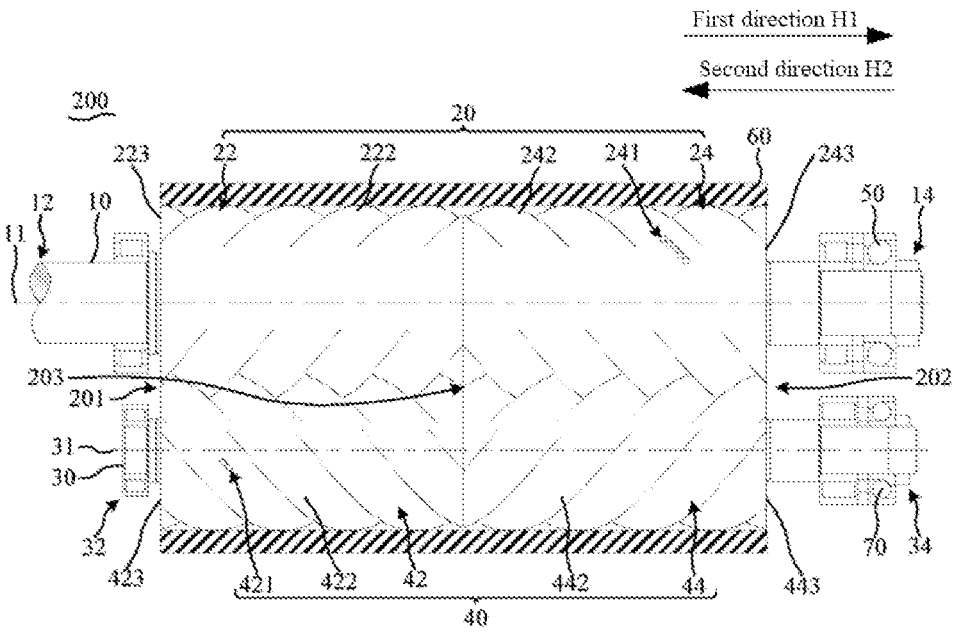
FIG. 6 is a schematic diagram of a part of a compressor according to a fifth embodiment of this disclosure.

In an optional embodiment of this disclosure, referring to FIG. 6, it shows a schematic diagram of a part of a compressor according to a fifth embodiment of this disclosure. The third air supply holes 421 are formed in the third portion 42 and the second air supply holes 241 are formed in the second portion 24. It should be noted that the third air supply holes 421 formed in the third portion 42 can be understood as the first air supply holes.

In an optional embodiment of this disclosure, the first air supply holes are formed in the third portion 42 and the second air supply holes are formed in the fourth portion 44.

In an optional embodiment of this disclosure, the first air supply holes 221 are formed in the first portion 22 and the second air supply holes are formed in the second portion 24 and the fourth portion 44.

In an optional embodiment of this disclosure, the first air supply holes 221 are formed in the third portion 42 and the second air supply holes are formed in the second portion 24 and the fourth portion 44.

In an optional embodiment of this disclosure, the first air supply holes are formed in the first portion 22 and the third portion 42 and the second air supply holes 241 are formed in the second portion 24.

In an optional embodiment of this disclosure, the first air supply holes are formed in the first portion 22 and the third portion 42 and the second air supply holes are formed in the fourth portion 44.

In an optional embodiment of this disclosure, at least one of the first portion 22 and the third portion 42 is provided with air supply holes; and/or at least one of the second portion 24 and the fourth portion 42 is provided with air supply holes.

Figure 7:
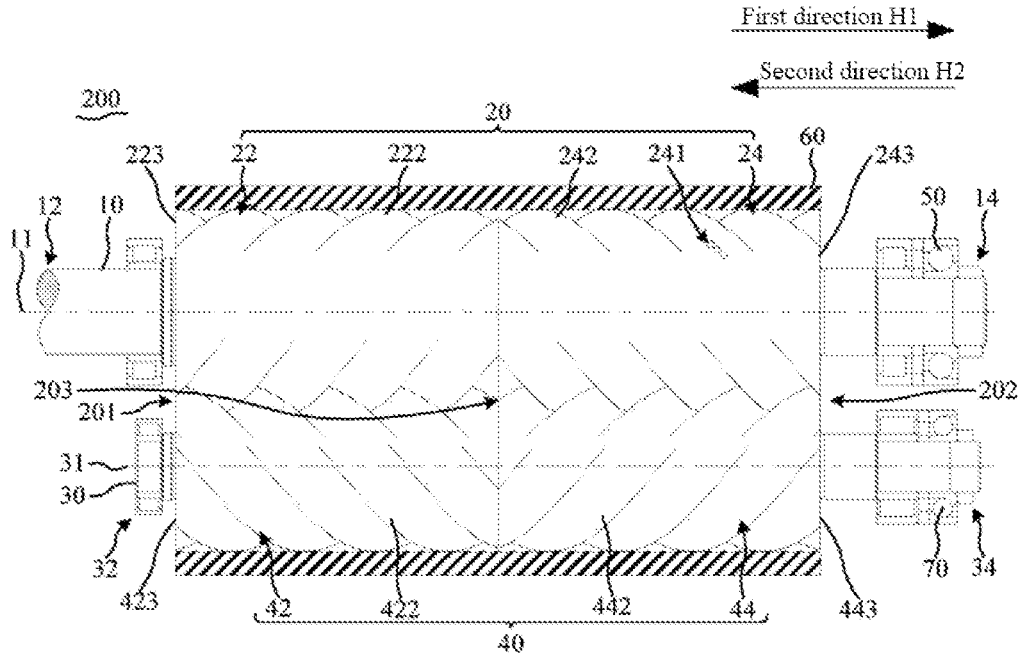
FIG. 7 is a schematic diagram of a part of a compressor according to a sixth embodiment of this disclosure.

In an optional embodiment of this disclosure, referring to FIG. 7, it shows a schematic diagram of a part of a compressor according to a sixth embodiment of this disclosure. At least one of the first portion 22 and the third portion 42 is not provided with any air supply holes, and at least one of the second portion 24 and the fourth portion 44 is provided with air supply holes, such as the second air supply holes 241. During the air supply process, the second portion 24 and the fourth portion 44 can be supplied with air and the first portion 22 and the third portion 42 are not supplied with air. During the rotation of the first rotor 20 and the second rotor 40, the air pressure formed by the first portion 22 and the third portion 42 is less than the air pressure formed by the second portion 24 and the fourth portion 44. Therefore, the air pressure difference between the first rotor 20 and the second rotor 40 is applied to the first thrust bearing 50 along the second direction H2.

In an optional embodiment of this disclosure, the shapes of portions of the housing corresponding to the first portion 22 and the third portion 42 are different from the shapes of portions of the housing corresponding to the second portion 24 and the fourth portion 44, so as to generate a pressure difference during the rotation of the first rotor 20 and the second rotor 40 to form a preset acting force applied to the first thrust bearing 50.

Figure 8:
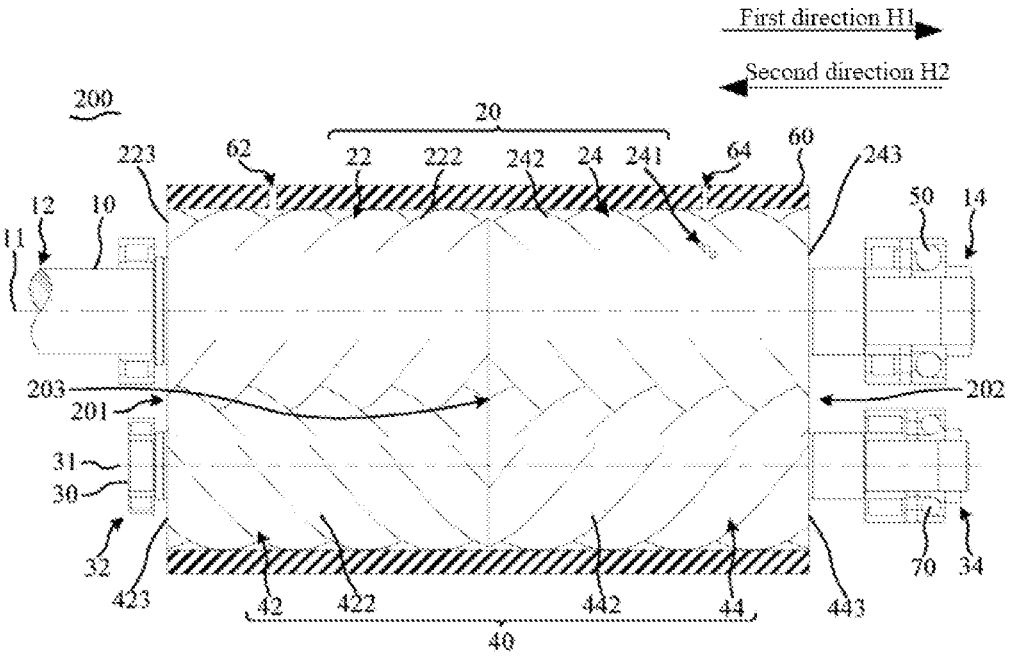
FIG. 8 is a schematic diagram of a part of a compressor according to a seventh embodiment of this disclosure.

In an optional embodiment of this disclosure, referring to FIG. 8, it shows a schematic diagram of a part of a compressor according to a seventh embodiment of this disclosure. The portions of the housing corresponding to the first portion 22 and the third portion 42 are provided with fourth air supply holes 62, and the portions of the housing corresponding to the second portion 24 and the fourth portion 44 are provided with fifth air supply holes 64. It should be noted that the fourth air supply holes 62 can be understood as the first air supply holes, and the fifth air supply holes 64 can be understood as second air supply holes. The relationship between the fourth air supply hole 62 and the fifth air supply hole 64 can refer to the relationship between the first air supply hole 221 and the second air supply hole 241, which will not be repeated here.

In an optional embodiment of this disclosure, the portions of the housing corresponding to the first portion 22 and the third portion 42 are not provided with any air supply holes, and the portions of the housing corresponding to the second portion 24 and the fourth portion 44 are provided with air supply holes, such as the fifth air supply holes 64.

Figure 9:
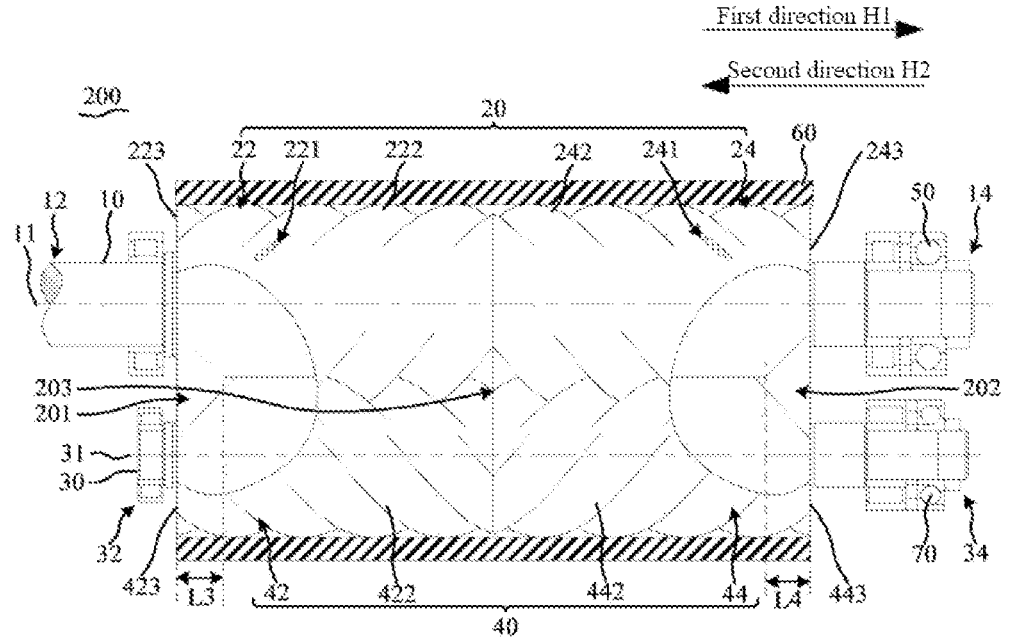
FIG. 9 is a schematic diagram of a part of a compressor according to an eighth embodiment of this disclosure.

In an optional embodiment of this disclosure, referring to FIG. 9, it shows a schematic diagram of a part of a compressor according to an eighth embodiment of this disclosure. The length L3 of the first exhaust port 201 along the direction from the first end 12 to the second end 14 is greater than the length L4 of the second exhaust port 202 along the direction from the second end 14 to the first end 12. That is, the length of the first exhaust port 201 along the first direction H1 is greater than the length of the second exhaust port 202 along the first direction H1. During the exhaust process, the displacement of the first exhaust port 201 is greater than the displacement of the second exhaust port 202. During the rotation of the first rotor 20 and the second rotor 40, the air pressure formed by the first portion 22 and the third portion 42 is less than the air pressure formed by the second portion 24 and the fourth portion 44. Therefore, the air pressure difference between the first rotor 20 and the second rotor 40 is applied to the first thrust bearing 50 along the second direction H2.

In the embodiment of this disclosure, in order to increase the air pressure difference between the first portion 22 and the third portion 42 and the second portion 24 and the fourth portion 44 and ensure the operation stability of the compressor 200, the shapes of portions of the housing corresponding to the first portion 22 and the third portion 42 can be different from the shapes of the portions of the housing corresponding to the second portion 24 and the fourth portion 44, and the shapes of the first portion 22 and the third portion 42 can be different from the shapes of the second portion 24 and the fourth portion 44 so that sufficient air pressure difference is generated during the rotation of the first rotor 20 and the second rotor 40 to form a preset acting force applied to the first thrust bearing 50. The case where the shapes of the portions of the housing corresponding to the first portion 22 and the third portion 42 are different from the shapes of the portions of the housing corresponding to the second portion 24 and the fourth portion 44 refers to the content disclosed above, which will not be repeated here. The case where the shapes of the first portion 22 and the third portion 42 are different from the shapes of the second portion 24 and the fourth portion 44 refers to the content disclosed above, which will not be repeated here. The embodiment of this disclosure realizes axial force orientation and a small difference between the exhaust ports on two sides, and ensures reliable operation of the compressor 200 regardless of whether the compressor 200 is supplied with air.

In an optional embodiment of this disclosure, during the rotation of the first rotor 20 and the second rotor 40, the axial force of the first rotor 20 and the second rotor 40 along the direction from the first end 12 toward the second end 14 is greater than the axial force along the direction from the second end 14 toward the first end 12 to form a preset acting force applied to the first thrust bearing 50. That is, the axial force of the first rotor 20 and the second rotor 40 along the first direction H1 is greater than the axial force of the first rotor 20 and the second rotor 40 along the second direction H2 to form a preset acting force applied to the first thrust bearing 50.

In an optional embodiment of the present disclosure, the axial force orientation for the first rotor 20 and the second rotor 40 can be realized under the action of the preset acting force. The first shaft 10 can be provided with a thrust bearing such as the first thrust bearing 50, and the second shaft 30 is not provided with a thrust bearing. It should be noted that, in the direction in which the axial force is oriented, the second rotor 40 can withstand contact and friction between the exhaust end surface of the second rotor and the exhaust end surface of the housing 60 without damage. For example, the second rotor 40 is made of a non-metallic material such as peek material. That is, the third portion 42 and the fourth portion 44 are not made of non-metallic materials such as the peek material. For another example, an anti-collision structure, such as a copper ring, is arranged between the second rotor 40 and the housing 60. That is, a third anti-collision structure 451 is arranged between an end of the third portion 42 away from the fourth portion 44 and the housing 60 of the compressor 200, and a fourth anti-collision structure 461 is arranged between an end of the fourth portion 44 away from the third portion 42 and the housing 60 of the compressor 200. It should also be noted that the first portion 22 and/or the second portion 24 are integrally formed with the first shaft 10, and the third portion 42 and the fourth portion 44 can rotate around the second shaft 30. The second shaft 30 is fixed on the housing 60 and does not rotate.

Figure 12:
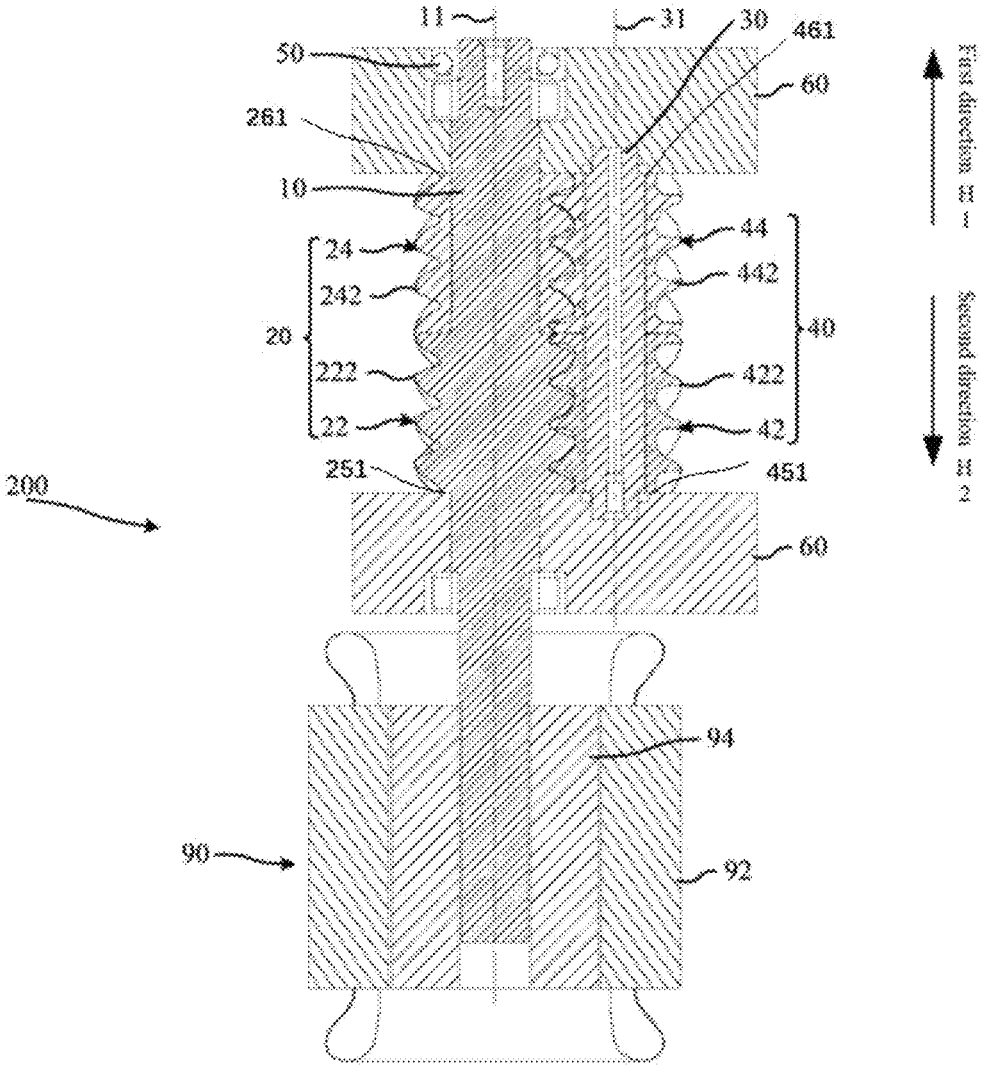
FIG. 12 is a schematic diagram of a part of a compressor according to an eleventh embodiment of this disclosure.

In an optional embodiment of the present disclosure, the axial force orientation for the first rotor 20 and the second rotor 40 can be realized under the action of the preset acting force. The first shaft 10 is not provided with a thrust bearing and the second shaft 30 is not provided with a thrust bearing. It should be noted that, in the direction in which the axial force is oriented, both the first rotor 20 and the second rotor 40 can withstand contact and friction between the exhaust end surface of the second rotor and the exhaust end surface of the housing 60 without damage. For example, both the first rotor 20 and the second rotor 40 are made of non-metallic materials such as the peek material. For another example, first and second an anti-collision structure 251 and 261, such as a copper ring, areis respectively arranged between the first rotor 20 and the housing 60, and third and fourth anti-collision structure 451 and 461, such as a copper ring, are respectively arranged between the second rotor 40 and the housing 60, as shown in FIG. 12.

Figure 10:
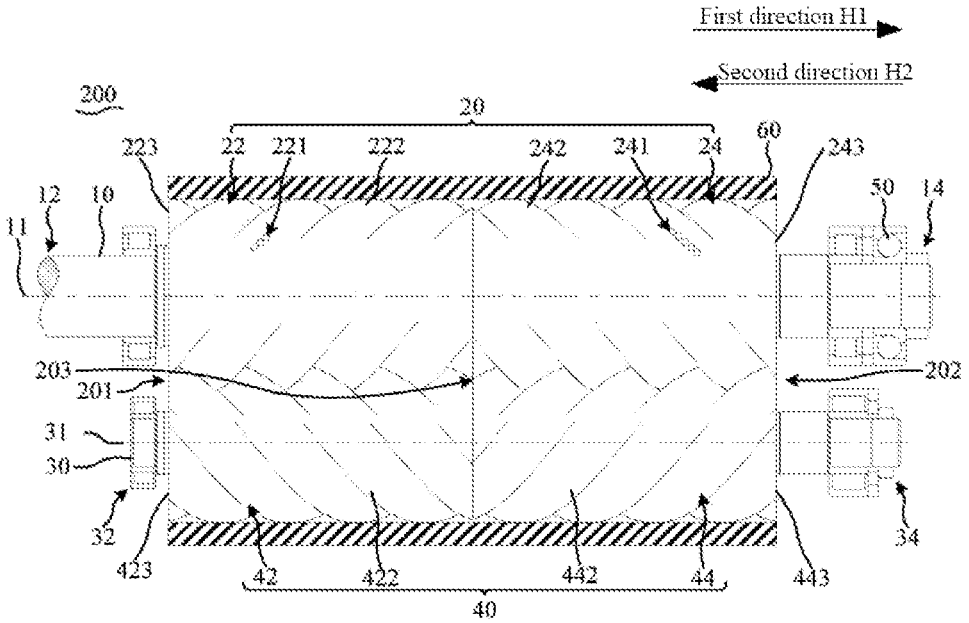
FIG. 10 is a schematic diagram of a part of a compressor according to a ninth embodiment of this disclosure.

Referring to FIG. 10, it shows a schematic diagram of a part of a compressor according to a ninth embodiment of this disclosure. The difference between the compressor 200 shown in FIG. 10 and the compressors 200 shown in FIGS. 1, 2, and 4-8 is that the second shaft 30 in the compressor 200 shown in FIG. 10 is not provided with any axial force thrust bearing. The second rotor 40 can be made of a non-metallic material such as the peek material, or an anticollision structure such as a copper ring is arranged between the second rotor 40 and the housing 60, so that the second rotor 40 is not easily damaged when the second rotor 40 comes into contact with the housing 60.

Referring to FIGS. 1, 2, and 4-9 again, in an optional embodiment of this disclosure, the compressor 200 may further include a second thrust bearing, and the second thrust bearing 70 is arranged on the second shaft 30, for example, on the fourth end 34 of the second shaft 30. In some other embodiments of this disclosure, the second thrust bearing 70 is arranged on the third end 32. During the rotation of the first rotor 20 and the second rotor 40, only a preset acting force in a determined and single direction is applied to the first thrust bearing 50 and the second thrust bearing 70. Therefore, in the embodiment of this disclosure, it is only required to arrange the first thrust bearing 50 on one shaft such as the first shaft 10 and arrange the second thrust bearing 70 on the second shaft 30 to realize the limitation on the resultant axial force in the determined and single axial direction, thereby ensuring that the first rotor 20 and the second rotor 40 of the compressor 200 in the embodiment of this disclosure can rotate stably without causing contact and friction between the exhaust end surfaces of the rotors and the end surface of the housing. Compared with the related art where two thrust bearings are required to be fixed on one shaft, the compressor of the embodiment of this disclosure can reduce two thrust bearings and the overall size and cost of the compressor. Moreover, due to the reduction in the number of thrust bearings, the efficiency of shafting operation can be improved to a certain extent, and the demand for lubricating oil can be reduced.

In an optional embodiment of the present disclosure, the axial force orientation for the first rotor 20 and the second rotor 40 can be realized under the action of the preset acting force. The first shaft 10 can be provided with a thrust bearing such as the first thrust bearing 50. The second shaft 30 can be provided with two thrust bearings, one of which can be the second thrust bearing 70. Compared with the prior art, the embodiment of this disclosure can reduce one thrust bearing for a compressor with two rotors.

In some other embodiments of the present disclosure, a structure for generating an additional acting force may be arranged on the compressor 200 to act on the first rotor 20 and the second rotor 40 when the first rotor 20 and the second rotor 40 are engaged with each other and rotate together, so that the compressor 200 generates a resultant axial force in a determined and unique direction between the first rotor 20 and the second rotor 40. The external force may be one of electromagnetism, gravity, oil pressure and the like. In the embodiment, the shapes of the first portion 22 and the second portion 24 may be the same or different. The shapes of the third portion 42 and the fourth portion 44 may be the same or different. The following describes the axial force orientation for the first rotor 20 and the second rotor 40 driven by an external force.

Figure 11:
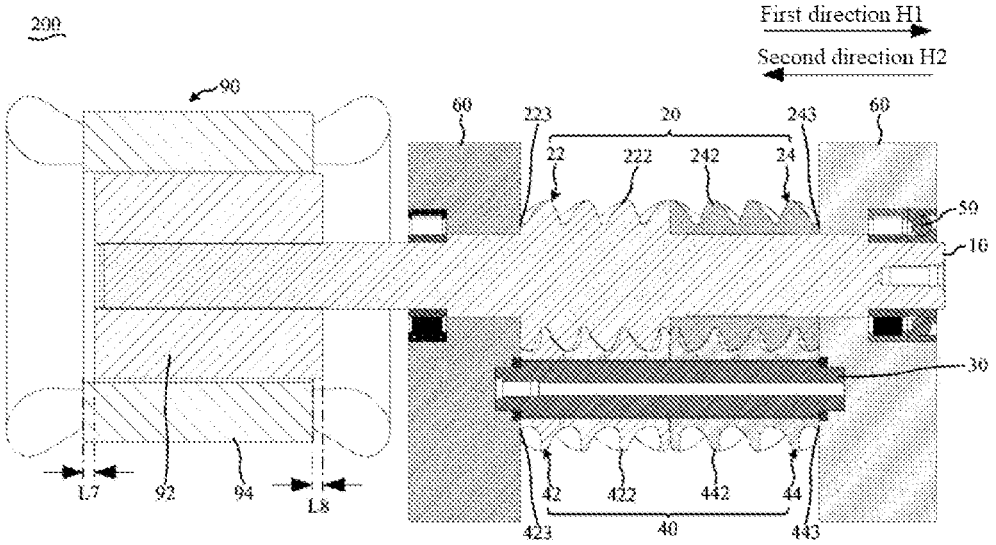
FIG. 11 is a schematic diagram of a part of a compressor according to a tenth embodiment of this disclosure.

Referring to FIG. 11, it shows a schematic diagram of a part of a compressor according to a tenth embodiment of this disclosure. The compressor 200 shown in FIG. 11 further includes a driving motor 90. The driving motor 90 includes a motor rotor 92 and a motor stator 94. The motor rotor 92 is arranged around a part of the first shaft 10, and the motor stator 94 is arranged around the motor rotor 92. At least one ends of the motor rotor 92 and the motor stator 94 along the direction of the first axis are misaligned from each other, such as one ends of the motor rotor 92 and the motor stator 94 away from the first rotor 20 and the second rotor 40 are misaligned from each other, and the other ends are flush. For another example, one ends of the motor rotor 92 and the motor stator 94 away from the first rotor 20 and the second rotor 40 are flush, and the other ends are misaligned from each other. For another example, one ends of the motor rotor 92 and the motor stator 94 away from the first rotor 20 and the second rotor 40 are misaligned from each other, and the other ends are also misaligned from each other.

In an optional embodiment of this disclosure, one ends of the motor rotor 92 and the motor stator 94 away from the first rotor 20 and the second rotor 40 are misaligned from each other, and the other ends are also misaligned from each other. One ends of the motor rotor 92 and the motor stator 94 away from the first rotor 20 and the second rotor 40 are misaligned from each other so that the ends of the motor rotor 92 and the motor stator 94 away from the first rotor 20 and the second rotor 40 form a first distance L7, and one ends of of the motor rotor 92 and the motor stator 94 near the first rotor 20 and the second rotor 40 are misaligned from each other so that the ends of the motor rotor 92 and the motor stator 94 near the first rotor 20 and the second rotor 40 form a second distance L8. The motor rotor 92 is closer to the first rotor 20 and the second rotor 40 than the motor stator 94. Therefore, in the embodiment of this disclosure, a closed magnetic loop is formed between the motor rotor 92 and the motor stator 94, and the motor rotor 92, as a current-carrying conductor, will be pulled by an electromagnetic force. Since the motor rotor 92 and the motor stator 94 are misaligned from each other and the motor rotor 92 is closer to the first rotor 20 and the second rotor 40 than the motor stator 94, the electromagnetic force generated by the driving motor 90 is no longer only tangential to the outer circle of the motor rotor 92, and an electromagnetic force opposite to the side to which the motor rotor 92 is deflected along the direction of the first axis will also be generated. That is, the electromagnetic force generated by the driving motor 90 is no longer only tangential to the outer circle of the motor rotor 92, and an electromagnetic force along the direction of the first axis toward the second direction H2 will also be generated. In this case, a resultant electromagnetic force acting on the motor rotor 92 can be decomposed to obtain an electromagnetic force in the direction of the first axis.

For a permanent magnet variable frequency motor, this electromagnetic force will always exist between the motor rotor 92 and the motor stator 94. For a three-phase asynchronous motor, this electromagnetic force will be generated between the motor rotor 92 and the motor stator 94 immediately after the driving motor is powered on. For the first rotor 20 and/or the second rotor 40, there is an electromagnetic force along the direction of the first axis, ensuring that the first rotor 20 and the second rotor 40 are always only subjected to an axial force in a fixed direction. So only one thrust bearing such as the first thrust bearing 50 is needed, and there is no reverse thrust bearing in the whole mechanism.

The compressor 200 can adopt the first rotor 20 and the second rotor 20 arranged transversely, so the required electromagnetic force only needs to be slightly greater than the maximum static friction force of the shafting.

In an optional embodiment of this disclosure, the lengths of the first distance L7 and the second distance L8 are the same. It can be understood that, in the related art, generally, the motor rotor and the motor stator of the driving motor have the same length and are substantially flush at two ends. In the embodiment of the present disclosure, the length of the first distance L7 and the second distance L8 are the same, and on the basis of the driving motor in the related art, the motor rotor 92 and the motor stator 94 can be directly misaligned to obtain the driving motor 90 defined in the embodiment of this disclosure. In this way, processing and assembly are facilitated. It can be understood that the lengths of the first distance L7 and the second distance L8 may also be different.

It should be noted that, in the embodiment of this disclosure, an additional magnetic member may be arranged in the compressor 200 to generate a magnetic force to realize the axial force orientation for the first rotor 20 and the second rotor 40. It can be understood that the additional magnetic member in the compressor 200 may directly generate a magnetic force, or may be powered on to generate an electromagnetic force. It should also be understood that the magnetic member needs to have a sufficiently large distance from the driving motor 90, or a shielding structure is arranged outside the driving motor 90, so that the magnetic force or electromagnetic force generated by the magnetic member will not interfere with the driving motor 90.

The second shaft 30 in the compressor 200 shown in FIG. 11 may not be provided with any thrust bearing, and the second rotor 40 may be made of a non-metallic material such as the peek material, or anti-collision structures are arranged on the inner walls of the second rotor 40 and the housing 60.

Referring to FIG. 12, it shows a schematic diagram of a part of a compressor according to an eleventh embodiment of this disclosure. The driving motor 90, the first rotor 20 and the second rotor 40 in the compressor 200 shown in FIG. 12 are arranged in a vertical direction. It can be understood as a gravity-type axial bearing structure. The first portion 22 and the second portion 24 of the first rotor 20 are placed vertically, the third portion 42 and the fourth portion 44 of the second rotor 40 are placed vertically, and the driving motor 90, the first rotor 20 and the second rotor 40 are placed vertically. Reasonable use of the self-gravity of the first rotor 20, the second rotor 40, and the driving motor 90 can make it clear that in the actual use process, before power-on, after power-off, and when the operation is unstable, the initial direction of the slight deviation is always downward, that is, along the second direction H2. The downward initial stress needs to be balanced by fixed-point orientation through technical solutions. On the premise that the initial stress direction is clearly downward, it is required to add a first thrust bearing 50 (or an angular contact bearing 50) on a non-motor side, i.e., the upper end shafting of the first rotor 20 of a gravity-type structure as shown in FIG. 12, i.e., the first shaft 10. In this way, in the case where the initial stress is generated, the first thrust bearing 50 can pull the first rotor 20. Since the initial gravity is extremely small relative to the air pressure generated by the opposed first rotor 20 and second rotor 40 in operation, only one angular contact bearing 50 with a high bearing capacity is required. An angular contact bearing 50 is arranged at the upper end to pull the first shaft 10 and the first rotor 20 on the first shaft 10 and the second rotor 40 engaged with the first rotor 20 which generate a short-term slight deviation. After normal operation, the axial air pressures of the first rotor 20 and the second rotor 40 can counterbalance each other.

According to the theoretical research, the opposed rotor structures of completely the same shape can generate completely the same air pressure. The axial air pressures counterbalance each other, and no angular contact bearing is installed in the shafting. However, the above-mentioned initial stress will appear during actual use, causing the first rotor 20 and the second rotor 40 to deviate. In addition, since there is no corresponding counterbalancing structure, the initial stress gradually increases, and the final displacement and deformation of the first rotor 20 and the second rotor 40 are greater than the end surface clearances of the first rotor 20 and the second rotor 40, causing the dangers, such as scratches in the end surfaces of the first rotor 20 and the second rotor 40 by the housing 60, jamming, and scrapping of the first rotor 20 and the second rotor 40. Conventionally, in the structure of the four-rotor compressor with non-oriented and fixed-point settings to counterbalance the initial stress, one or more angular contact bearings are installed on two sides, resulting in serious cost waste, redundant product structure, increased operating power consumption, and reduced product energy efficiency.

According to the embodiment of this disclosure, since the first rotor 20 and the second rotor 40 of the gravity-type structure generate a downward initial stress, it is clear that the initial deviation direction of the first shaft 10 and the first rotor 20 on the first shaft 10 is downward. An angular contact bearing 50 is configured on the non-motor side of the first rotor 20, i.e., the shafting above the first rotor 20, to accurately bear the short-term slight deviation generated when the first rotor 20 and the second rotor 40 are unstable, thereby effectively preventing the housing 60 from scratching then end surfaces of the first rotor 20 and the second rotor 40. In terms of structure, the number of bearings is reduced, the difficulty of assembly is reduced, the transitional redundancy of the shafting is prevented, the configuration of moving parts is reduced, the cost of materials and production is reduced, and energy efficiency is improved.

The second shaft 30 in the compressor 200 shown in FIG. 12 may not be provided with any thrust bearing, and the second rotor 40 may be made of a non-metallic material such as the peek material, or anti-collision structures are arranged on the inner walls of the second rotor 40 and the housing 60.

The embodiment of this disclosure realizes unidirectional axial force, i.e., axial force orientation, and only one thrust bearing is required to be arranged on one shaft, or one thrust bearing is arranged on one of the two shafts and no thrust bearing is arranged on the other shaft. Compared with the compressor in the prior art that needs to arrange two thrust bearings on one shaft, the embodiments of this disclosure can reduce one thrust bearing on one shaft. Moreover, due to the technology of axial force orientation, the machine always keeps the axial force in a preset direction during operation, thus ensuring the stable operation of the machine. When the stable operation of the machine is ensured, the overall size of the screw compressor can be reduced to reduce costs.

In addition, compared with the prior art, the embodiments of this disclosure can reduce the use of thrust bearings, thereby reducing machine loss and lubricating oil demand, and further reducing the failure rate of the compressor 200 and increasing the service life of the compressor.

In the compressor 200 in the above one or more embodiments, the first portion 222 and the second portion 242 of the first rotor 20 and/or the third portion 422 and the fourth portion 442 of the second rotor 24 can be understood as a rotor assembly or a rotor set. In other words, the first rotor 20 and the second rotor 40 in the compressor 200 in one or more of the above embodiments can be understood as a rotor assembly or a rotor set.

The compressor 200 in one or more of the above embodiments can be applied to an air conditioner.

An embodiment of this disclosure further provides an air conditioner, including the compressor 200 defined according to one or a combination of more of the above embodiments.

The rotor assembly, compressor and air conditioner according to the embodiments of this disclosure have been described in detail above, and specific examples are used herein to illustrate the principles and implementations of this disclosure. The above description of the embodiments is only used to help understand the method of this disclosure and its core concept. Moreover, for those skilled in the art, based on the concept of this disclosure, there will be changes in the specific embodiments and application scope. In summary, the content of this description should not be understood as limiting this disclosure.

The invention claimed is:

1. A compressor, comprising:

a first rotor being rotatable around a first axis, the first rotor comprising a first portion and a second portion;

a first shaft configured to carry the first portion and the second portion, the first shaft having a first end and a second end that are oppositely arranged; and a housing accommodating the first rotor and a portion of the first shaft;

wherein the first rotor is configured to be applied with a preset acting force in a direction from the first end toward the second end or from the second end toward the first end during rotation, a second rotor being rotatable around a second axis, the second rotor comprising a third portion engaged with the first portion and a fourth portion engaged with the second portion;

a second shaft configured to carry the third portion and the fourth portion; and the housing accommodating the second rotor and a portion of the second shaft;

wherein the second rotor is configured to be applied with a preset acting force in a direction from the first end toward the second end or from the second end toward the first end during the rotation of the first rotor and the second rotor; and wherein at least one of the first portion and the third portion is provided with first air supply holes, the second portion and the fourth portion is provided with second air supply holes, the first air supply holes and the second air supply holes are configured to be different from each other to generate an air pressure difference during the rotation of the first rotor and the second rotor to form the preset acting force.

2. The compressor according to claim 1, wherein the compressor is configured to satisfy at least one of the following:

a shape of the first portion is different from shapes of the second portion and the fourth portion; and a shape of the third portion is different from shapes of the second portion and the fourth portion, so that an air pressure difference is generated during the rotation of the first rotor and the second rotor to form the preset acting force.

3. The compressor according to claim 1, wherein shapes of the first portion, the second portion, the third portion and the fourth portion comprise any one of the following: length, a number of helical blades, end surface profile, a density of the helical blades, and diameter.

4. The compressor according to claim 1, wherein the compressor is configured to satisfy at least one of the following:

a number of first air supply holes is different from a number of second air supply holes; and/or a size of the first air supply hole is different from a size of the second air supply hole;

a distance between the first air supply holes and an end surface of the first portion away from the second portion is different from a distance between the second air supply holes and an end surface of the second portion away from the first portion; and a distance between the first air supply holes and an end surface of the third portion away from the fourth portion is different from a distance between the second air supply holes and an end surface of the fourth portion away from the third portion.

5. The compressor according to claim 1, wherein the compressor is configured to satisfy at least one of the following: at least one of the first portion and the third portion is provided with air supply holes; and at least one of the second portion and the fourth portion is provided with air supply holes.

6. The compressor according to claim 1, wherein the compressor is configured to satisfy at least one of the following:

a portion of the housing corresponding to the first portion has a different shape from portions of the housing corresponding to the second portion and the fourth portion; and a portion of the housing corresponding to the third portion has a different shape from the portions of the housing corresponding to the second portion and the fourth portion so that an air pressure difference is generated during the rotation of the first rotor and the second rotor to form the preset acting force.

7. The compressor according to claim 1, wherein the housing is provided with a first exhaust port and a second exhaust port, and a length of the first exhaust port along a direction from the first end toward the second end is different from a length of the second exhaust port along a direction from the second end toward the first end.

8. The compressor according to claim 1, wherein the compressor is configured to satisfy at least one of the following:

the portion of the housing corresponding to the first portion;

the portion of the housing corresponding to the third portion is provided with first air supply holes, and the portion of the housing corresponding to the second portion;

the portion of the housing corresponding to the fourth portion is provided with second air supply holes;

a number of first air supply holes is different from a number of second air supply holes;

a size of the first air supply hole is different from a size of the second air supply hole;

a distance between the first air supply holes and an end surface of the first portion away from the second portion is different from a distance between the second air supply holes and an end surface of the second portion away from the first portion; and a distance between the first air supply holes and an end surface of the third portion away from the fourth portion is different from a distance between the second air supply holes and an end surface of the fourth portion away from the third portion.

9. The compressor according to claim 1, wherein the compressor is configured to satisfy at least one of the following:

at least one of the portion of the housing corresponding to the first portion and the portion of the housing corresponding to the third portion is provided with air supply holes, and at least one of the portion of the housing corresponding to the second portion and the portion of the housing corresponding to the fourth portion is provided with air supply holes.

10. The compressor according to claim 1, wherein the first portion and the second portion are arranged along the direction of gravity, the third portion and the fourth portion are arranged along the direction of gravity, and the gravity of the first portion, the second portion, the third portion, the fourth portion, the first shaft and the second shaft causes the first rotor and the second rotor to be applied with the preset acting force during the rotation of the first rotor and the second rotor; or the arrangement direction of the first portion and the second portion has an included angle less than 90 degrees relative to the direction of gravity, the arrangement direction of the third portion and the fourth portion is the same as that of the first portion and the second portion, component forces of the first portion, the second portion, the third portion, the fourth portion, the first shaft and the second shaft along the direction of gravity cause the first rotor and the second rotor to be applied with the preset acting force during the rotation of the first rotor and the second rotor.

11. The compressor according to claim 1, wherein a pressure of an oil acting on the first end is lower than a pressure of an oil acting on the second end, so that the first rotor and the second rotor are applied with the preset acting force during rotation; or a pressure of an oil acting on a third end of the second shaft is lower than a pressure of an oil acting on a fourth end of the second shaft so that the first rotor and the second rotor are applied with the preset acting force during rotation.

12. The compressor according to claim 1, further comprising:

a first thrust bearing arranged at the first end or the second end, the preset acting force being to be applied to the first thrust bearing.

13. The compressor according to claim 1, wherein the first shaft is not provided with a thrust bearing, and both the first portion and the second portion are made of non-metallic materials.

14. The compressor according to claim 1, wherein the first shaft is not provided with a thrust bearing, a first anti-collision structure is arranged between an end of the first portion away from the second portion and the housing of the compressor, and a second anti-collision structure is arranged between an end of the second portion away from the first portion and the housing of the compressor.

15. The compressor according to claim 1, further comprising:

a first thrust bearing arranged at the first end or the second end; and a second thrust bearing arranged at a third end or a fourth end, the preset acting force being to be applied to the first thrust bearing and the second thrust bearing.

16. The compressor according to claim 1, further comprising:

a first thrust bearing arranged at the first end or the second end, the preset acting force being to be applied to the first thrust bearing;

wherein the second shaft is not provided with a thrust bearing, the third portion and the fourth portion are made of non-metallic materials;

wherein at least one of first portion and the second portion is integrally formed with the first shaft, and the third portion and the fourth portion are rotatable around the second shaft.

17. The compressor according to claim 1, further comprising:

a first thrust bearing arranged at the first end or the second end, the preset acting force being to be applied to the first thrust bearing;

wherein the first shaft is not provided with a thrust bearing, a third anti-collision structure is arranged between an end of the third portion away from the fourth portion and the housing of the compressor, and a fourth anti-collision structure is arranged between an end of the fourth portion away from the third portion and the housing of the compressor; and wherein at least one of the first portion and the second portion is integrally formed with the first shaft, and the third portion and the fourth portion are rotatable around the second shaft.

18. A compressor, comprising:

a housing provided with a first exhaust port and a second exhaust port;

a first rotor being rotatable within the housing around a first axis, the first rotor comprising a first portion and a second portion; and a second rotor being rotatable within the housing around a second axis, the second rotor comprising a third portion engaged with the first portion and a fourth portion engaged with the second portion;

wherein the first exhaust port is located at the same ends of the first rotor and the second rotor, the second exhaust port is located at the same ends of the first rotor and the second rotor, the first exhaust port and the second exhaust port are located at different ends of the first rotor, the first exhaust port and the second exhaust port are located at different ends of the second rotor, a length of the first exhaust port in a direction parallel with the first axis is greater than a length of the second exhaust port in a direction parallel with the first axis; and wherein at least one of the first portion and the third portion is provided with first air supply holes, the second portion and the fourth portion is provided with second air supply holes, the first air supply holes and the second air supply boles are configured to be different from each other to generate an air pressure difference during the rotation of the first rotor and the second rotor to form the preset acting force.

19. The compressor according to claim 18, further comprising:

a first shaft carrying the first portion and the second portion;

a second shaft carrying the third portion and the fourth portion; and a first thrust bearing arranged on the first shaft and located on the same sides of the first portion or the second portion.

20. A compressor, comprising:

a housing:

a first rotor being rotatable within the housing around a first axis, the first rotor comprising a first portion and a second portion; and a second rotor being rotatable within the housing around a second axis, the second rotor comprising a third portion engaged with the first portion and a fourth portion engaged with the second portion;

at least one of the first portion, the third portion, a portion of the housing corresponding to the first portion and a portion of the housing corresponding to the third portion is provided with first air supply holes, and at least one of the second portion, the fourth portion, a portion of the housing corresponding to the second portion and a portion of the housing corresponding to the fourth portion is provided with second air supply holes, wherein the compressor is configured to satisfy at least of the following:

a number of first air supply holes is less than a number of second air supply holes;

a size of the first air supply hole is less than a size of the second air supply hole; and a distance between the first air supply holes and an end surface of the first portion away from the second portion is greater than a distance between the second air supply holes and an end surface of the second portion away from the first portion.

21. The compressor according to claim 20, further comprising:

a first shaft carrying the first portion and the second portion;

a second shaft carrying the third portion and the fourth portion; and a first thrust bearing arranged on the first shaft and located on the same sides of the first portion or the second portion.

22. A compressor, comprising:

a housing:

a first rotor being rotatable within the housing around a first axis, the first rotor comprising a first portion and a second portion; and a second rotor being rotatable within the housing around a second axis, the second rotor comprising a third portion engaged with the first portion and a fourth portion engaged with the second portion;

wherein the first portion, the third portion, a portion of the housing corresponding to the first portion and a portion of the housing corresponding to the third portion are all not provided with any air supply holes, and at least one of the second portion, the fourth portion, the portion of the housing corresponding to the second portion and a portion of the housing corresponding to the fourth portion is provided with air supply holes.

23. The compressor according to claim 22, further comprising:

a first shaft carrying the first portion and the second portion;

a second shaft carrying the third portion and the fourth portion; and a first thrust bearing arranged on the first shaft and located on the same sides of the first portion or the second portion.

24. A rotor assembly, comprising:

a first rotor, comprising a first portion and a second portion which are rotatable around a first axis; and a second rotor being rotatable around a second axis, the second rotor comprising a third portion engaged with the first portion and a fourth portion engaged with the second portion;

wherein at least one of the first portion and the third portion is provided with first air supply holes, and at least one of the second portion and the fourth portion is provided with second air supply holes;

a number of first air supply holes is less than a number of second air supply holes;

a size of the first air supply hole is less than a size of the second air supply hole; and a distance between the first air supply holes and an end surface of the first portion away from the second portion is greater than a distance between the second air supply holes and an end surface of the second portion away from the first portion.

25. A rotor assembly, comprising:

a first rotor, comprising a first portion and a second portion which are rotatable around a first axis; and a second rotor being rotatable within the housing around a second axis, the second rotor comprising a third portion engaged with the first portion and a fourth portion engaged with the second portion;

wherein the rotor assembly is configured with at least one of the following:

at least one of the first portion and the third portion is provided with first air supply holes; and at least one of the second portion and the fourth portion is provided with second air supply holes, and wherein the first air supply holes and the second air supply holes are configured to be different from each other to generate an air pressure difference during the rotation of the first rotor and the second rotor to form the preset acting force.

26. A rotor assembly, comprising: a first rotor being rotatable around a first axis, wherein the first rotor comprises a first portion provided with first air supply holes and a second portion provided with second air supply holes, wherein the rotor assembly is configured to satisfy at least one of the following:

a number of first air supply holes is less than a number of second air supply holes;

a size of the first air supply hole is less than a size of the second air supply hole; and a distance between the first air supply holes and an end surface of the first portion away from the second portion is greater than a distance between the second air supply holes and an end surface of the second portion away from the first portion.

* * * * *